United States Patent [19]

Knol

[11] Patent Number: 4,793,423

[45] Date of Patent: Dec. 27, 1988

[54] PROCESS FOR TREATING DRILLED CUTTINGS

[75] Inventor: Beth C. Knol, Traverse City, Mich.

[73] Assignee: Shell Western E&P Inc., Houston, Tex.

[21] Appl. No.: 59,435

[22] Filed: Jun. 8, 1987

Related U.S. Application Data

[63] Continuation-in-part of Ser. No. 926,023, Oct. 31, 1986, abandoned.

[51] Int. Cl.[4] ..... E21B 21/06

[52] U.S. Cl. ..... 175/66; 175/88; 175/207; 210/806

[58] Field of Search ..... 175/66, 88, 207; 210/806; 166/266, 268

[56] References Cited

U.S. PATENT DOCUMENTS

| | | | |
|---|---|---|---|
| 2,225,973 | 12/1940 | Brown et al. | 175/66 X |
| 2,457,959 | 1/1949 | Walker | 166/266 X |
| 2,674,440 | 4/1954 | Donovan | 175/66 |
| 2,919,898 | 1/1960 | Marwil et al. | 175/66 |
| 2,953,204 | 9/1960 | Doscher et al. | 166/266 |
| 3,433,312 | 3/1969 | Burdyn et al. | 175/66 |
| 3,681,238 | 8/1972 | Emmett, Jr. | 166/268 X |
| 4,200,529 | 4/1980 | Fink et al. | 210/806 X |
| 4,222,988 | 9/1980 | Barthel | 175/66 X |
| 4,378,056 | 3/1983 | Gay, Jr. | 175/66 |
| 4,395,338 | 7/1983 | Rowton | 175/66 X |
| 4,427,551 | 1/1984 | Duveau | 210/806 |
| 4,546,783 | 10/1985 | Lott | 175/66 |

*Primary Examiner*—George A. Suchfield

[57] ABSTRACT

Used drilling fluids, drilled cuttings and salt contaminated soil, etc., are processed for disposal or reuse by staged water-washing and solids separating procedures which are monitored for the salinity of the water contacting the particles and are repeated to the extent necessary to obtain selected low values, in order to produce saline wash water suitable for injecting into a disposal well and size-graded substantially salt-free materials suitable for construction operations or non-hazardous waste disposal.

21 Claims, 1 Drawing Sheet

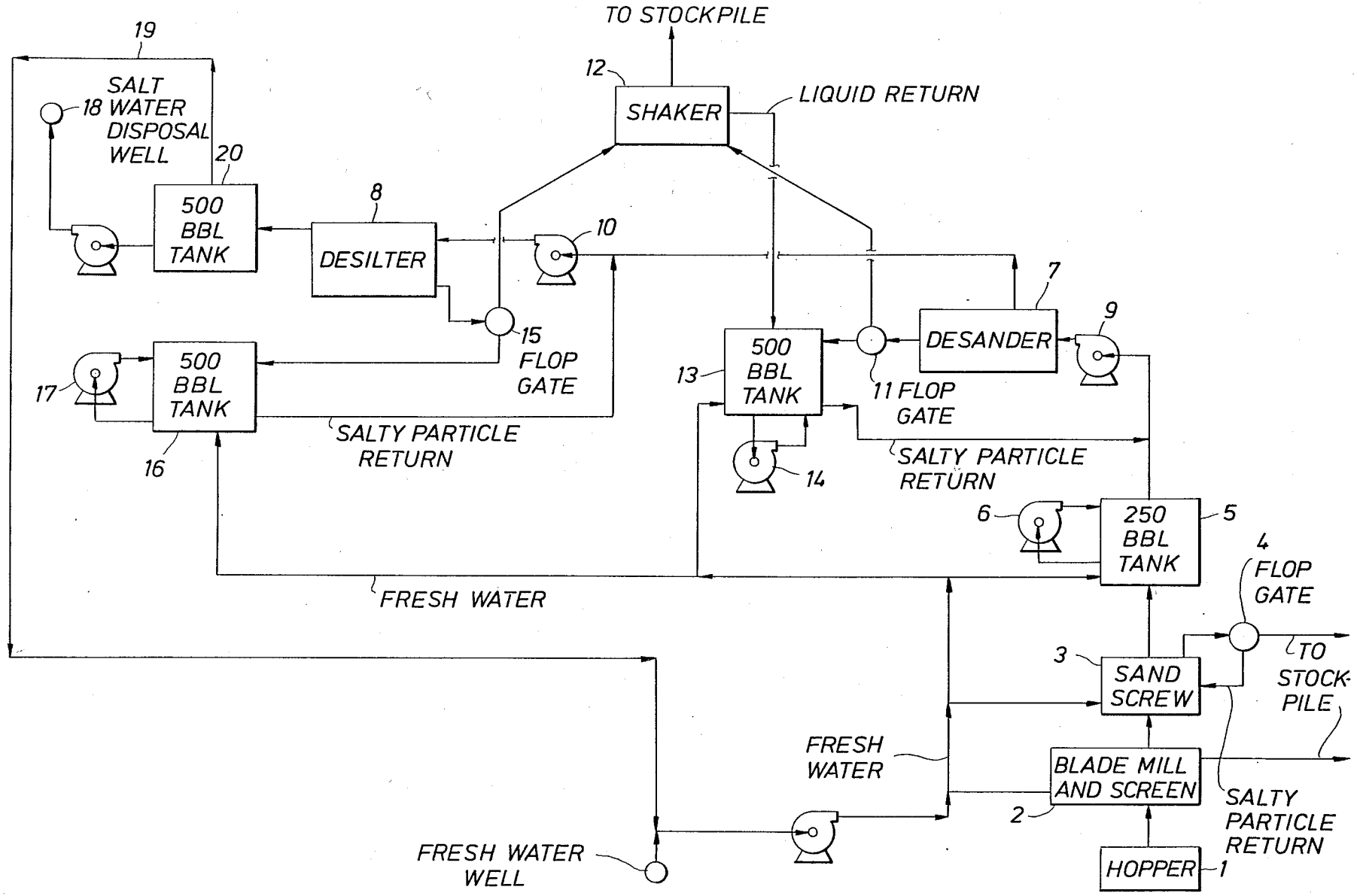
HOPPER
1
BLADE MILL AND SCREEN
2
SAND SCREW
3
4 FLOP GATE
TO STOCK-PILE
SALTY PARTICLE RETURN
250 BBL TANK
5
6
FRESH WATER
FRESH WATER WELL
FRESH WATER
DESANDER
7
9
11 FLOP GATE
SALTY PARTICLE RETURN
500 BBL TANK
13
14
LIQUID RETURN
SHAKER
12
TO STOCKPILE
10
15 FLOP GATE
SALTY PARTICLE RETURN
DESILTER
8
500 BBL TANK
20
500 BBL TANK
16
17
SALT WATER DISPOSAL WELL
18
19

PROCESS FOR TREATING DRILLED CUTTINGS

RELATED APPLICATIONS

This application is a continuation-in-part of assignee's copending application Ser. No. 926,023, filed Oct. 31, 1986, now abandoned on "A Process for Treating Drilled Cuttings."

BACKGROUND OF THE INVENTION

This invention relates to a process for training used drilling fluids and drilling cuttings, particularly those in which the salt content is high enough to present a disposal problem. More particularly, the invention relates to a staged water washing and solids removal process for converting used salt water drilling fluids, drilled solids and/or drilling fluid mud pit residues to a source of desalinated solid particles of selected sizes suitable for uses as, for example, construction or restoration materials, or for disposal as a non-hazardous waste.

In various regions, tanks are used for storing drilling fluids and cuttings because reserve pits are not permitted. In addition, removal may be required from presently existing reserve pits. In such reserve pits, the used drilling fluid contents are mixed with, or contaminated by, top soil and the material used in constructing the pits. The present process avoids the onerous expense of hauling such materials from reserve pits or tanks to hazardous waste disposal locations which may be hundreds of miles from the drilling sites.

SUMMARY OF THE INVENTION

The invention relates to a process for converting components in drilled cuttings to substantially non-saline solid materials, which may be reused in some useful manner, or disposed of as a non-hazardous waste material. The drilled cuttings components are mixed and agitated with water in successive steps to separate substantially all of the larger particles in a variety of size ranges and to suspend the very fine particles in water. The largest particles are separated and washed with water. The slurry resulting from separation of the largest particles is mixed and agitated with additional water, and particles of various sizes are removed in successive steps of mixing, agitating and separating. In each of these succeeding steps, where the salinity of water on or draining from the separated particles is insufficient to provide a salinity level acceptable for reuse of the materials, or for disposal as a non-hazardous waste, both the mixing and agitating of the various sized particles with fresh water and the separating of a given size range of particles are repeated, to the extent necessary, to provide such a salinity reduction. The separated particles are collected, either by size range, or all together, prior to disposal or reuse. The remaining slurry water containing only very fine particles is reused in the separation process or in some other useful manner, or disposed of in some environmentally acceptable manner.

For convenience, the term "drilled cuttings" is used herein to refer to used drilling fluids, drilling solids and/or drilling fluid mud pit residues and/or slurries of such materials. As used herein, the term "salinity" of a substance refers to an amount of disssolved or soluble salt, such as an alkali or alkaline earth metal, which, in solution, releases the same number of ions that would be released by the same amount of sodium chloride (NaCl). Drilled cuttings commonly contain NaCl, potassium chloride (KCl), magnesium chloride ($MgCl_2$), and calcium chloride ($CaCl_2$), and the present process is well suited for reducing the salinity due to any or all of such salts.

BRIEF DESCRIPTION OF THE DRAWING

The drawing is a flow sheet for a preferred embodiment of the present process.

DESCRIPTION OF THE INVENTION

The present invention is, at least in part, premised on a discovery that the presently described combination of procedures and devices are advantageous relative to various other combinations. For example, the ojective of desalinating the components of drilled cuttings might be accomplished by subjecting those components to (a) aggregate washing equipment combined with a clarifier or (b) subjecting such components to such washing equipment combined with mud plant and solids control devices.

It was found that the first option, utilizing the clarifier was significantly less efficient in handling fine materials because when isolated, the fine materials have a water content higher than those of the same material isolated by means of solids control equipment. Because of that, less salt would be removed during each cycle through the clarifier and more recycling would be needed to reach a selected reduced salinity. In addition, when the fresh water consumed per pound of salt removed is compared, a clarifier does not perform as well as solids control equipment.

The drawing illustrates a particularly suitable treatment of drilled cuttings components by means of a combination of aggregate washing equipment and mud plant solids control equipment in accordance with the present invention. As shown, the salt contaminated materials being treated are dumped from trucks into hopper 1 which feeds a conveyer, such as a belt, for carrying the material to a blade mill and screen 2.

A suitable blade mill is basically a horizontal tub which encloses a conveyor shaft on which are mounted screw flights and paddles. The purpose of such a blade mill is to precondition material for separation by forming a slurry of the drilled cuttings. Water is introduced to saturate the materials uniformly while the paddles agitate, scrub, and abrade the material so that lumps are broken up and the individual particles form a slurry. The slurry drops onto a screen associated with the blade mill, where jets spray water onto the cuttings. In the illustrated embodiment, particles which are generally larger than sand size and have average diameters greater than about ⅜-inch, are separated by the screen and are transported to a stockpile. The wet or water-suspended slurry of finer particles that pass through the screen associated with the blade mill are fed, preferably by a chute (not shown), to a sand screw means 3.

A sand screw of the type shown separates particles such as coarse sand-sized particles between about 150 mesh and ⅜-inch from finer materials. A suitable form of such a sand screw includes a base tub in which the materials enter and an inclined tub that contains an auger. The particles are subjected to a tumbling action of the rotating continuous screw flights of the auger and an introduction of a rising current of fresh water into the base tub of the sand screw means. A suspension of the finer particles are carried upward by a flow of water and pass over a weir into a mixing tank while the coarser particles are conveyed by the auger and are substantially drained and squeezed dry of water, for example, to a water content of about 18–25 w%.

In the preferred embodiment, the salinity of the water drained from the coarse sand-sized particles is measured by an electrical resistivity measuring device (not shown) arranged to control a flop gate 4 for directing separated particles to either a stockpile or a salty particle return. If the water drained from, or remaining on the surfaces of such particles, has a salinity equivalent to no more than a selected target concentration, such as less than about 2500 ppm NaCl equivalent, the particles are sent to a stockpile. The target concentration may be set by criteria for non-hazardous waste disposal.

Where the salt concentration of such water (which amounts to a salt-leaching water which contacted the particles) is higher than the target concentration, the particles are returned for remixing and reseparation within the sand screw 3, as indicated by the arrow labeled "salty particle return." Such remixing and reseparating is repeated until a selected level of salt concentration is reached. During this processing, feeding of the new batches of contaminated materials into the hopper 1 and on the blade mill 2 may be delayed.

The water suspended slurry of particles smaller than about 150 mesh are conveyed to a mixing tank 5 in which the water is circulated by a pump 6. More water is added to the suspension, preferably until a precentage of the suspended solids within the liquid is about 5 to 7% by volume, and is within the operational constraints of a relatively fine solids control means, such as a desander 7 and desilter 8. As known in the art, the concentration of such slurried particles can be measured manually by vaporizing water from the slurry or automatically by means of gauges of the types used in municipal sewage plants. The slurry is displaced by pump means 9 into desander 7.

A suitable desander consists of a series of tapered cones in which solid particles are separated from liquid by means of the centrifugal force generated by the swirling of the slurry inside the cones. The solid particles exit through the tapered end of the cones while the liquid flow out the top. The desander 7 is preferably arranged to remove isolated fine sand-sized particles having average sizes in the range of about 80–100 microns to 150 mesh. Most of the liquid and the clay and silt-sized or smaller particles are displaced by pump 10 into the desilter 8.

The water draining from, or left on the surfaces of the relatively fine sand-sized particles separated from desander 7, is measured for salinity by a measuring device (not shown) which controls flop gate 11 to direct those particles onto the shaker 12 or, where the salinity is equivalent to a value higher than the target concentration, to tank 13. In that tank, the salty particles are mixed with relatively fresh water circulated by pump 14, and delivered through the salty particle return line to a point upstream of the desander for redilution and reseparation within the desander.

The slurry of substantially clay and silt sized particles, which may have sizes ranging from about 12 microns to about 80–100 microns, are separated in desilter 8 in a manner analogous to that of desander 7. The separated clay and silt-sized particles are similarly measured for salinity and directed by a flop gate 15 to either the shaker 12, when their salinity is equivalent to or less than a selected target value, or to tank 16, in which they are mixed with fresh water circulated by pump 17 through the salty particle return line for redilution and separation in desilter 8.

The slurry water separated by desilter 8 is preferably monitored for salinity and where it is substantially fresh water, it is either directed through the water recycle line 19 for reuse. Where the water is unsuitable for reuse in the process, it is directed to some environmental acceptable disposal, such as injection into a saltwater disposal well 18 for underground injection. The water could also be used in a secondary recovery water flooding operation, or for some other useful purpose.

A suitable shaker 12 is arranged to receive the relatively fine sand-sized particles from desander 7 or clay and silt sized particles from desilter 8, and to allow any free moisture to drain through the shaker screen and return to tank 13. The particles separated from shaker 12 are conveyed to a stockpile.

In the illustrated embodiment of the present invention, substantially salt-free particles from drilling fluid cuttings are made available for some useful purpose, such as the construction of well site access roads, drilling pads or central production facilities, etc. In the winter the sand-sized materials can be used for sanding roads. Very fine materials having no construction value can be added to topsoil or tilled with other soils for restoration of construction or drilling sites. Other useful purposes are considered to be within the scope of the invention. Alternatively, the separated particles may be disposed of in a manner suitable for non-hazardous wastes.

The present invention is particularly applicable to the treating of salt water muds and drilled cuttings saturated with saline fluid or substantially any mixture containing significant proportions of dissolved and granular salt, as well as the reserve pit residues inclusive of the drilling fluid permeated layers of soil underlying such mud pits. Examples of suitable types of drilling fluids include any brine mud made from water and commercially prepared salts or brine water produced in association with oil and gas.

In general, the equipment such as pumps, screens, blade mills, sand screws, desanders, desilters, shakers, and the like, can be substantially any of the currently available devices or techniques designed for use in oil field operations such as the drilling of oil and concrete batching operations. Examples of particularly suitable items of such equipment include the SWECO 12 cone desilter, Model PO4C12, and Brandt SE-10 desilter; SWECO 2 cone desander, Model P10C02, and Brandt SRC-2 desander; Kolberg Series 8000 Log Washer blade mill, and Eagle 18-inch×24-foot blade mill; Eagle 44 in. Single Screw Washer-Classifier-Dehydrator sand screw, and Kolberg Series 5000 Sand Prep, Single Screw sand screw.

Where desirable or necessary, the present process can be operated to reduce the salinity of the produced solid materials to salinities significantly lower than 2500 ppm NaCl equivalent. In a preferred operation, the recycling stages are repeated to the extent necessary to reduce the salinities to less than about 1000 ppm NaCl equivalent.

What is claimed is:

1. A process for converting components in drilled cuttings to useful materials which are substantially non-saline, comprising:

mixing and agitating said components with sufficient substantially fresh water for separating substantially all of the individual particles and at least substantially suspending most finer particles in the water;

mechanically isolating particles having sizes generally larger than sand size;

suspending the particles not larger than generally sand-sized particles in substantially fresh water and mechanically isolating the sand-sized particles from the suspended particles;

repeating the mixing and agitating of the isolated particles to the extent required to reduce the salinity of water draining from, or remaining on their surfaces, to a selected value less than about 2500 ppm sodium chloride equivalent; and in succession, further diluting the remaining suspension of particles, mechanically isolating smaller fractions of particles, and to the extents necessary, repeating the diluting and isolating treatments of the isolated particles in order to provide a plurality of fractions of isolated particles which are wetted with or are productive of drained-off water having a lower salinity than one equivalent to a selected salinity less than that of a water solution containing 2500 ppm sodium chloride equivalent.

2. A process for treating components of drilled cuttings comprising:

mixing and agitating said components with substantially fresh water to an extent separating lumps into individual particles; screening off particles having diameters larger than about ⅜-inch;

mechanically separating from the remaining materials particles having sizes of about 150 mesh to ⅜-inch while suspending smaller particles in substantially fresh water and dewatering the isolated particles to a water content of about 18 to 25% by weight;

measuring the salinity of water draining from or remaining on surfaces of the isolated particles and recycling those having a salinity equivalent to that of a water solution containing more than a selected value less than about 2500 ppm sodium chloride equivalent by means of repeated dilutions and isolations of such particles to an extent required to reduce their salinity below the selected value;

diluting the suspension of particles smaller than about 150 mesh with substantially fresh water to a reduced solids content suitable for a centrifugal desanding operation;

centrifugally isolating particles having sizes in the order of 80 microns to 150 mesh and rediluting them with substantially fresh water and reisolating them to the extent required to reduce the salinity of water on or draining from their surfaces to less than said selected sodium chloride equivalent;

centrifugally separating from the remaining slurry of particles those particles having sizes less than about 80 microns and rediluting them with substantially fresh water and reseparating them to the extent needed to reduce the water on or draining from their surfaces below said selected sodium chloride equivalent; and disposing of any remaining substantially solids-free water having a salinity greater than said sodium chloride equivalent by injecting it into a salt water disposal well.

3. A process for rendering saline drilled well cuttings suitable for disposal as a non-hazardous waste, comprising:

mixing the drilled cuttings with water to form a slurry;

agitating the drilled cuttings slurry;

separating the slurried drilled cuttings from the water;

repeating the mixing, agitating and separating of the drilled cuttings until the salinity of the water entrained on the drilled cuttings is reduced to a level acceptable for non-hazardous waste;

disposing of the drilled cuttings in a manner suitable for non-hazardous wastes, and disposing of the slurry water in an environmentally acceptable manner.

4. The process of claim 3 wherein the slurry water is injected into an underground injection disposal well.

5. The process of claim 3 wherein the slurry water is injected into a well as part of a water flooding secondary oil recovery operation.

6. A process for converting saline drilled well cuttings into useful materials comprising:

mixing the drilled cuttings with water to form a slurry;

agitating the drilled cuttings slurry;

separating the slurried drilled cuttings from the water;

repeating the mixing, agitating and separating of the drilled cuttings until the salinity of the water entrained on the drilled cuttings is reduced to a level acceptable for reuse;

using the treated drilled cuttings in some useful manner; and disposing of slurry water in an environmentally acceptable manner.

7. The process of claim 6 wherein the slurry water is injected into an underground injection disposal well.

8. The process of claim 6 wherein the slurry water is injected into a well as part of a water flooding secondary oil recovery operation.

9. A process for rendering saline drilled well cuttings suitable for disposal as a non-hazardous waste, comprising:

gathering the drilled cuttings for processing, mixing the drilled cuttings with water to form a substantially uniform slurry of chunks, coarse sand, fine sand, clay, silt and other very fine particles;

separating large chunks of drilled cuttings from the uniform slurry;

sending the large chunks of drilled cuttings to a collection point;

mixing the remaining slurry of coarse sand and finer particles with additional water to form a substantially uniform, less concentrated slurry of coarse sand and finer particles;

separating coarse sand particles from the slurry of coarse sand and finer particles;

sending the coarse sand particles to a collection point after the salinity of the water entrained on the coarse sand particles is reduced to a level acceptable for non-hazardous waste disposal;

mixing the remaining slurry of fine sand and finer particles with additional water to form a substantially uniform, less concentrated slurry of fine sand and finer particles;

separating fine sand particles from the slurry of fine sand and finer particles;

sending the fine sand particles to a collection point after the salinity of the water entrained on the fine sand particles is reduced to a level acceptable for non-hazardous waste disposal;

mixing the remaining slurry of clay, silt and finer particles with additional water to form a substantially uniform, less concentrated slurry of clay, silt and finer particles;

separating silt and clay particles from the slurry of clay, silt, and finer particles;

sending the silt and clay particles to a collection point after the salinity of the water entrained on the silt and clay particles is reduced to a level acceptable for non-hazardous waste disposal;

disposing of the remaining slurry water containing very fine particles in an environmentally acceptable manner; and disposing of the separated chunks, coarse sand, fine sand, clay and silt in a manner suitable for non-hazardous wastes.

10. The process of claim 9 wherein the large chunks of drilled cuttings are sent to a first collection point, the coarse sand particles and the fine sand particles are sent to a second collection point, and the silt and clay particles are sent to a third collection point.

11. A process for converting saline drilled well cuttings into useful materials comprising:

gathering the drilled cuttings for processing, mixing the drilled cuttings with water to form a substantially uniform slurry of chunks, coarse sand, fine sand, clay, silt and other very fine particles;

separating large chunks of drilled cuttings from the uniform slurry;

sending the large chunks of drilled cuttings to a collection point;

mixing the remaining slurry of coarse sand and finer particles with additional water to form a substantially uniform, less concentrated slurry of coarse sand and finer particles;

separating coarse sand particles from the slurry of coarse sand and finer particles;

sending the coarse sand particles to a collection point after the salinity of the water entrained on the coarse sand particles is reduced to a level acceptable for reuse of the coarse sand;

mixing the remaining slurry of fine sand and finer particles with additional water to form a substantially uniform, less concentrated slurry of fine sand and finer particles;

separating fine sand particles from the slurry of fine sand and finer particles;

sending fine sand particles from the slurry of fine sand and finer particles;

sending the fine said particles to a collection point after the salinity of the water entrained on the fine sand particles is reduced to a level acceptable for reuse of the fine sand;

mixing the remaining slurry of clay, silt and finer particles with additional water to form a substantially uniform, less concentrated slurry of clay, silt and finer particles;

separating silt and clay particles from the slurry of clay, silt and finer particles;

sending the silt and clay particles to a collection point after the salinity of the water entrained on the silt and clay particles is reduced to a level acceptable for reuse of the silt and clay particles;

disposing of the remaining slurry water containing very fine particles in an environmentally acceptable manner; and utilizing the separated chunks, coarse sand, fine sand, clay and silt in some useful manner.

12. The process of claim 11 wherein the large chunks of drilled cuttings are sent to a first collection point, the coarse sand particles and the fine sand particles are sent to a second collection point, and the silt and clay particles are sent to a third collection point.

13. A process for rendering saline-drilled well cuttings suitable for disposal as a non-hazardous waste, comprising:

gathering the drilled cuttings for processing, mixing the drilled cuttings with water to form a substantially uniform slurry of chunks, coarse sand, fine sand, clay, silt and other very fine particles;

separating large chunks of drilled cuttings, sized greater than $\frac{3}{8}$ inch, from the uniform slurry by use of a blade mill;

sending the large chunks of drilled cuttings to a collection point;

mixing the blade mill exiting slurry with additional water to form a substantially uniform, less concentrated slurry of coarse sand and finer particles;

separating coarse sand particles, sized from greater than 150 mesh to $\frac{3}{8}$ inch, from the remaining slurry of coarse sand and finer particles by use of a sand screw;

sending the coarse sand particles to a collection point after the salinity of the water entrained on the coarse sand particles is reduced to a level acceptable for non-hazardous waste disposal;

mixing the sand screw exiting slurry with additional water to form a substantially uniform, less concentrated slurry of fine sand and finer particles;

separating fine sand particles, sized from greater than 80–100 microns to 150 mesh, from the slurry of fine sand and finer particles by use of a desander;

sending the fine sand particles to a collection point for treated drilled cuttings after the salinity of the water entrained on the fine sand particles is reduced to a level acceptable for non-hazardous waste disposal;

mixing the desander exiting slurry with additional water to form a substantially uniform, less concentrated slurry of clay, silt and finer particles;

separating silt and clay particles, sized from greater than 12 microns to 80–100 microns, from the remaining drilled cuttings slurry by use of a desilter;

sending the silt and clay particles to a collection point after the salinity of the water entrained on the silt and clay particles is reduced to a level acceptable for non-hazardous waste disposal;

disposing of the desilter exiting slurry water containing very fine particles in an environmentally acceptable manner; and disposing of the separated chunks, coarse sand, fine sand, clay and silt in a manner suitable for non-hazardous wastes.

14. The process of claim 13 wherein the large chunks of drilled cuttings are sent to a first collection point, the coarse sand particles and the fine sand particles are sent to a second collection point, and the silt and clay particles are sent to a third collection point.

15. A process of converting saline drilled well cuttings into useful materials comprising:

gathering the drilled cuttings for processing, mixing the drilled cuttings with water to form a substantially uniform slurry of chunks, coarse sand, fine sand, clay, silt and other very fine particles;

separating large chunks of drilled cuttings, sized greater that $\frac{3}{8}$ inch, from the uniform slurry by use of a blade mill;

sending the large chunks of drilled cuttings to a collection point;

mixing the blade mill exiting slurry with additional water to form a substantially uniform, less concentrated slurry of coarse sand and finer particles;

separating coarse sand particles, sized from greater than 150 mesh to $\frac{3}{8}$ inch, from the remaining slurry of coarse sand and finer particles by use of a sand screw;

sending the coarse sand particles to a second collection point after the salinity of the water entrained on the coarse sand particles is reduced to a level acceptable for reuse of the coarse sand;

mixing the sand screw exiting slurry with additional water to form a substantially uniform, less concentrated slurry of fine sand and finer particles;

separating fine sand particles, sized from greater than 80–100 microns to 150 mesh, from the slurry of fine sand and finer particles by use of a desander;

sending the fine sand particles to a third collection point for treated drilled cuttings after the salinity of the water entrained on the fine said particles is reduced to a level acceptable for reuse of the fine sand;

mixing the desander exiting slurry with additional water to form a substantially uniform, less concentrated slurry of clay, silt and finer particles;

separating silt and clay particles, sized from greater than 12 microns to 80–100 microns, from the remaining drilled cuttings slurry by use of a desilter;

sending the silt and clay particles to a fourth collection point after the salinity of the water entrained on the silt and clay particles is reduced to a level acceptable for reuse of the silt and clay particles;

disposing of the desilter exiting slurry water containing very fine particles in an environmentally acceptable manner; and utilizing the separated chunks, coarse sand, fine sand, clay and silt in some useful manner.

16. The process of claim 15 wherein the large chunks of drilled cuttings are sent to a first collection point, the coarse sand particles and the fine sand particles are sent to a second collection point, and the silt and clay particles are sent to a third collection point.

17. The process of claim 9 wherein all of the collection points are the same.

18. The process of claim 11 wherein all of the collection points are the same.

19. The process of claim 13 wherein all of the collection points are the same.

20. The process of claim 15 wherein all of the collection points are the same.

21. A process for treating saline drilled well cuttings comprising:

mixing the drilled cuttings with water to form a slurry;

agitating the drilled cuttings slurry;

separating the slurried drilled cuttings from the water;

repeating the mixing, agitating and separating of the drilled cuttings until the salinity of the water entrained on the drilled cuttings is reduced to a level acceptable for reuse;

utilizing a portion of the treated drilled cuttings in some useful manner;

disposing of a portion of the treated drilled cuttings in a manner suitable for non-hazardous wastes; and disposing of the slurry water in an environmentally acceptable manner.

* * * * *